US010145394B2

(12) United States Patent
Kobayashi

(10) Patent No.: US 10,145,394 B2
(45) Date of Patent: Dec. 4, 2018

(54) FLUID PRESSURE CYLINDER

(71) Applicant: KYB-YS CO., LTD., Nagano (JP)

(72) Inventor: Nobuyuki Kobayashi, Nagano (JP)

(73) Assignee: KYB-YS Co., Ltd., Nagano (JP)

( * ) Notice: Subject to any disclaimer, the term of this patent is extended or adjusted under 35 U.S.C. 154(b) by 253 days.

(21) Appl. No.: 14/906,606

(22) PCT Filed: Jun. 6, 2014

(86) PCT No.: PCT/JP2014/065127
§ 371 (c)(1),
(2) Date: Jan. 21, 2016

(87) PCT Pub. No.: WO2015/012003
PCT Pub. Date: Jan. 29, 2015

(65) Prior Publication Data

US 2016/0160893 A1 Jun. 9, 2016

(30) Foreign Application Priority Data

Jul. 26, 2013 (JP) ..... 2013-155369

(51) Int. Cl.
*F15B 15/14* (2006.01)

(52) U.S. Cl.
CPC ..... *F15B 15/1457* (2013.01); *F15B 15/1447* (2013.01); *F15B 15/1461* (2013.01); *F15B 15/149* (2013.01)

(58) Field of Classification Search
CPC ..... F15B 15/1447; F15B 15/1461; F15B 15/1457
USPC ..... 92/165 PR
See application file for complete search history.

(56) References Cited

U.S. PATENT DOCUMENTS

| | | | | |
|---|---|---|---|---|
| 3,489,442 | A | 1/1970 | Wright | |
| 5,507,218 | A * | 4/1996 | Lipinski | F15B 15/082 92/143 |
| 2014/0251126 | A1* | 9/2014 | Kobayashi | F15B 15/149 92/169.1 |

FOREIGN PATENT DOCUMENTS

| | | | |
|---|---|---|---|
| JP | 46-036874 | Y1 | 12/1971 |
| JP | 48-012498 | B1 | 4/1973 |
| JP | 64-006403 | U | 1/1989 |
| JP | 01-078705 | U | 5/1989 |
| JP | 04-049262 | U | 4/1992 |
| JP | 2003-166508 | A | 6/2003 |
| JP | 2004-068927 | A | 3/2004 |

(Continued)

*Primary Examiner* — Thomas E Lazo
*Assistant Examiner* — Daniel Collins
(74) *Attorney, Agent, or Firm* — Rabin & Berdo, P.C.

(57) ABSTRACT

A hydraulic cylinder includes a rod inner passage that is formed in a piston rod along an axial direction and communicates a fluid pressure source and an interior of a cylinder tube; a plug that is inserted from an open end that opens to the interior of the cylinder tube of the rod inner passage; a lateral hole that is formed in the piston rod along a radial direction and extends so as to cross the rod inner passage; and a pin that is inserted into the lateral hole. In the piston rod, an inner-circumference screw portion is formed on an inner circumference of the rod inner passage, and on the plug, an outer-circumference screw portion that is screwed into the inner-circumference screw portion and an engagement portion that is engaged with the pin and locks rotation of the plug are formed.

6 Claims, 6 Drawing Sheets

(56) References Cited

FOREIGN PATENT DOCUMENTS

JP 2013096510 A * 5/2013 ..... F15B 15/149

* cited by examiner

FLUID PRESSURE CYLINDER

TECHNICAL FIELD

The present invention relates to a fluid pressure cylinder that is operated so as to extend/contract by working-fluid pressure guided from a working-fluid pressure source.

BACKGROUND ART

JP2003-166508A discloses a hydraulic cylinder in which a first passage and a second passage are formed in a piston rod.

In this hydraulic cylinder, an interior of a cylinder tube into which the piston rod is inserted is partitioned into a head-side chamber and a bottom-side chamber by a piston that is linked to the piston rod. When the hydraulic cylinder is operated so as to extend, pressurized working oil from a hydraulic power source is supplied to the bottom-side chamber through the first passage, and the working oil in the head-side chamber is returned to a tank of the hydraulic power source through the second passage. When the hydraulic cylinder is operated so as to contract, the pressurized working oil from the hydraulic power source is supplied to the head-side chamber through the second passage, and the working oil in the bottom-side chamber is returned to the tank of the hydraulic power source through the first passage.

The first passage and the second passage are defined by two axial holes respectively formed in the solid piston rod.

The first passage communicates the hydraulic power source with the bottom-side chamber. On a first end of the axial hole defining the first passage, a first port that is connected to the hydraulic power source through a pipe is formed. A second end of the axial hole defining the first passage opens to the bottom-side chamber.

The second passage communicates the hydraulic power source with the head-side chamber. On a first end of the axial hole defining the second passage, a second port that is connected to the hydraulic power source through a pipe is formed. In a middle part of the axial hole defining the second passage, a communicating hole that extends in the radial direction of the piston rod and opens to the head-side chamber is formed.

On the axial hole defining the second passage, an assembly hole that extends in the radial direction of the piston rod from a vicinity of an open end of the bottom-side chamber is formed. A columnar closing member (a plug) is plugged in the assembly hole, and communication between the head-side chamber and the bottom-side chamber is blocked by the closing member.

SUMMARY OF INVENTION

In the hydraulic cylinder described in JP2003-166508A, the axial hole and the assembly hole defining the second passage extend orthogonally to each other, and a middle part of the axial hole is blocked by the closing member that is plugged in the assembly hole. Therefore, there is a risk that adequate sealing may not be achieved between the closing member and the axial hole if there is a large machining error during processing of the assembly hole.

In order to deal with this problem, it is conceivable to form a screw portion on an inner circumference of the axial hole and to close an open end of the axial hole with the plug that is screwed into the screw portion.

However, in the case in which the plug is attached by being screwed into the axial hole, there is a risk that, the plug may be loosened and fall off to the interior of the cylinder tube (the bottom-side chamber) due to repetitive action, on both end surfaces of the plug, of hydraulic pressure that is guided to the head-side chamber and the bottom-side chamber when the hydraulic cylinder is operated.

An object of the present invention is to ensure a sufficient sealability of a plug that closes a rod inner passage formed in a piston rod and to prevent the plug from falling off to an interior of a cylinder tube.

According to one aspect of the present invention, a fluid pressure cylinder in which a piston rod moves in an axial direction by working-fluid pressure guided from a fluid pressure source to an interior of a cylinder tube, includes a rod inner passage that is formed in the piston rod along the axial direction and communicates the fluid pressure source with the interior of the cylinder tube; a plug that is inserted from an open end that opens to the interior of the cylinder tube of the rod inner passage; a lateral hole that is formed in the piston rod along a radial direction and extends so as to cross the rod inner passage; and a pin that is inserted into the lateral hole. In the piston rod, an inner-circumference screw portion is formed on an inner circumference of the rod inner passage. On the plug, an outer-circumference screw portion that is screwed into the inner-circumference screw portion and an engagement portion that is engaged with the pin and locks rotation of the plug are formed.

DESCRIPTION OF EMBODIMENTS

A fluid pressure cylinder according to embodiments of the present invention will be described below with reference to the drawings.

First Embodiment

Figure 1:
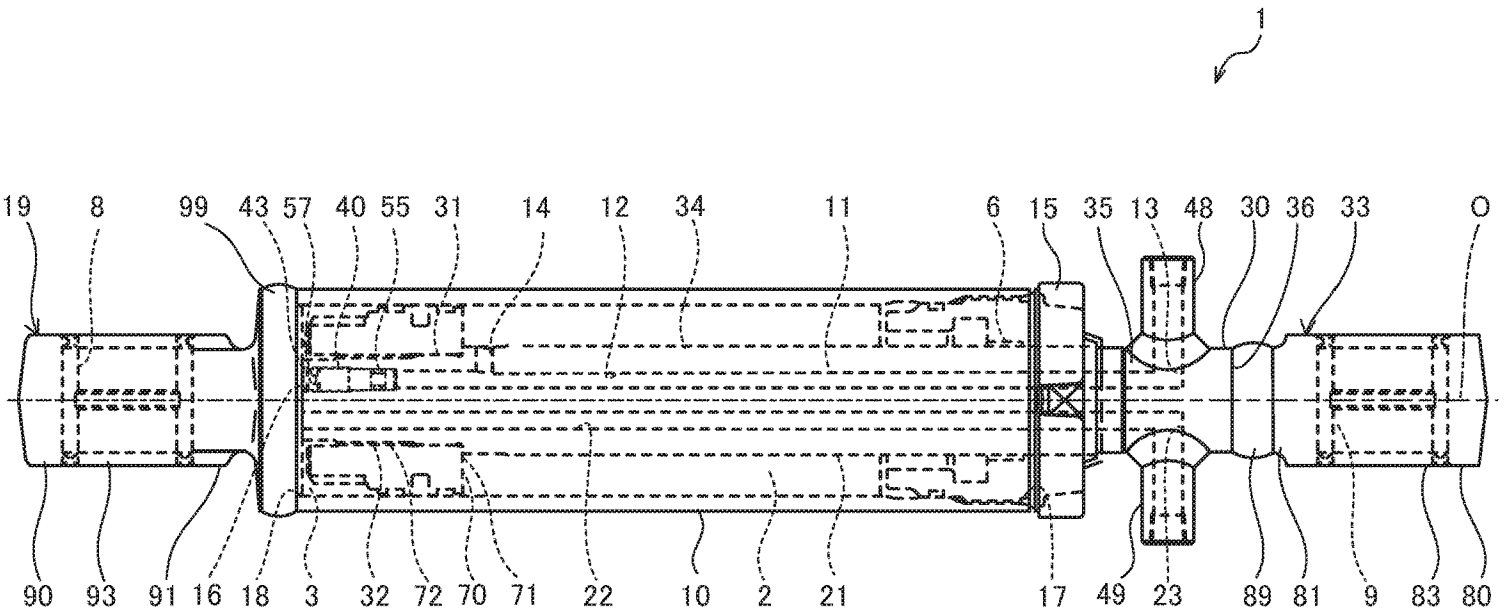
FIG. 1 is a front view of a fluid pressure cylinder according to a first embodiment of the present invention.

A hydraulic cylinder 1 serving as the fluid pressure cylinder shown in FIG. 1 includes a cylindrical cylinder tube 10, a piston 70 that partitions the interior of the cylinder tube 10 into a head-side chamber 2 and a bottom-side chamber 3, and a piston rod 30 that is linked with the piston 70 and projects out from a first end of the cylinder tube 10.

The head-side chamber 2 is provided on the head side at which the piston rod 30 projects out from the cylinder tube 10 and is defined between the piston 70 and a cylinder head 15, which will be described below. The bottom-side chamber 3 is provided on the bottom side at which the piston rod 30 does not project out from the cylinder tube 10 and is defined between the piston 70 and a bottom bracket 90, which will be described below.

The hydraulic cylinder 1 is operated so as to extend/contract by movement of the piston rod 30 relative to the cylinder tube 10 in the axial direction by working oil pressure (working-fluid pressure) guided from a hydraulic power source (a working-fluid pressure source), which is not shown. Thereby, it is possible to drive a second member that is linked to the cylinder tube 10 relative to a first member (not shown) that is linked to the piston rod 30. The term "the axial direction" means the direction in which a center axis O of the piston rod 30 extends.

Although the hydraulic cylinder 1 uses the working oil (oil) as the working fluid, the hydraulic fluid such as, for example, aqueous alternative fluid etc. may be used instead of the working oil.

The cylinder tube 10 is formed to have a cylindrical shape. The cylinder head 15, through which the piston rod 30 is slidably inserted, is fastened to a tip-end-side open end 17 (on the right end side in FIG. 1) of the cylinder tube 10. The cylinder head 15 slidably supports the piston rod 30 via a bearing 6.

The bottom bracket 90 that is linked to a member (not shown) is provided on a proximal-end-side open end 18 (on the left end side in FIG. 1) of the cylinder tube 10. A cylinder tube assembly 19 is formed of the cylinder tube 10, the bottom bracket 90, and so forth.

The bottom bracket 90 has a connecting end portion 91 that is connected to the open end 18 of the cylinder tube 10 by a welded portion 99 and a ring-shaped eye bracket portion 93. A bush (bearing) 8 is provided on the inner side of the eye bracket portion 93. A proximal end portion of the cylinder tube 10 is linked to a member via a pin (not shown) inserted into the bush 8.

A rod head 80 that is linked to a member (not shown) is provided on a tip end (a right end in FIG. 1) of the piston rod 30. A piston rod assembly 33 is formed of the piston rod 30, the rod head 80, and so forth.

The rod head 80 has a connecting end portion 81 that is connected to tip end 36 of the piston rod 30 by a welded portion 89 and a ring-shaped eye bracket portion 83. A bush (bearing) 9 is provided on the inner side of the eye bracket portion 83. A tip end portion of the rod head 80 is linked to a member via a pin (not shown) inserted into the bush 9.

Figure 2:
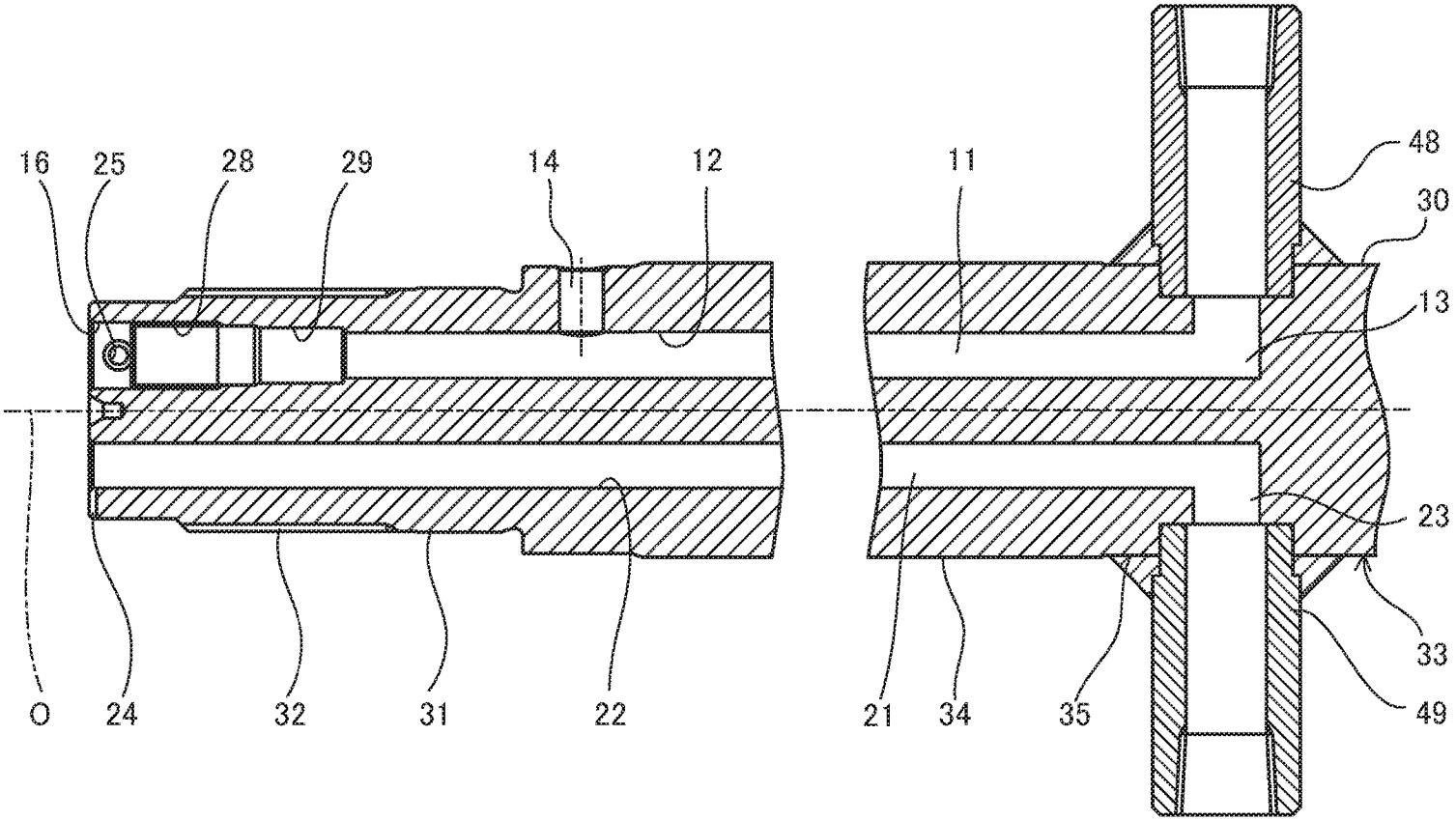
FIG. 2 is a sectional view of a piston rod.

As shown in FIG. 2, the piston rod 30 is formed by using a solid columnar member. The piston rod 30 has a pipe connecting portion 35 to which pipes extending from the hydraulic power source are connected, a rod portion 34 that is supported by the bearing 6 of the cylinder head 15, and a piston supporting portion 31 that supports the piston 70.

A male screw portion 32 is formed on an outer circumference of the piston supporting portion 31. A female screw portion 72 is formed on an inner circumference of the piston 70. The piston 70 is fastened to the piston rod 30 by screwing the female screw portion 72 of the piston 70 with the male screw portion 32 of the piston supporting portion 31.

Figure 3:
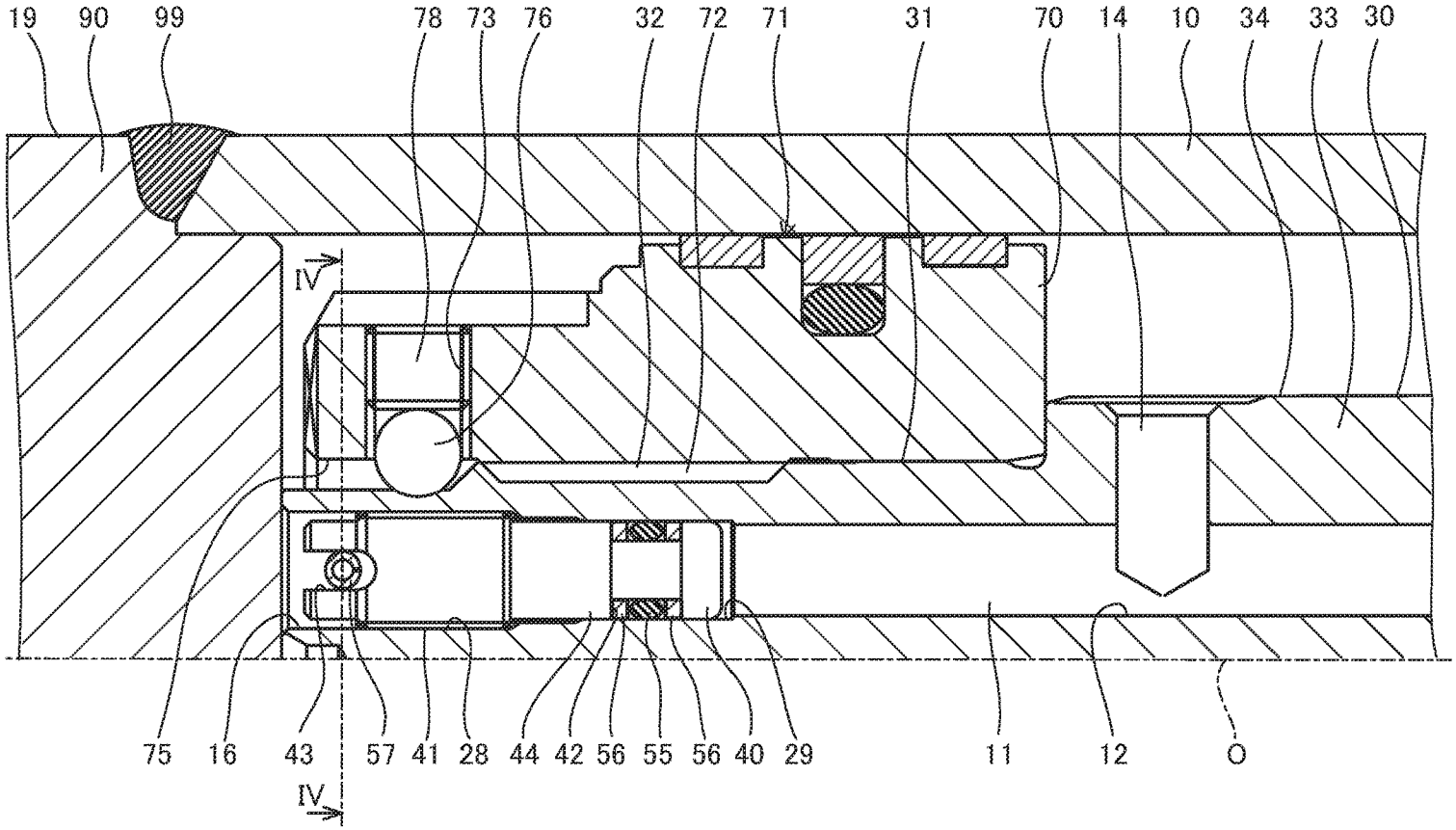
FIG. 3 is a sectional view of the fluid pressure cylinder.

As shown in FIG. 3, the piston 70 has a rotation locking mechanism that locks rotation of the piston 70. The rotation locking mechanism has a screw 78 that is screwed into a screw hole 73 formed on the piston 70 and a ball 76 that is pressed by the screw 78 against an outer circumference of the piston rod 30.

A piston assembly 71 is formed of the piston 70, the ball 76, the screw 78, and so forth.

The piston assembly 71 is not limited to the configuration mentioned above, and the piston assembly 71 may have a piston that is linked to the piston rod 30 and a nut that is screwed into the piston rod 30. In this case, because rotation of the piston is locked by the fastening force of the nut, the rotation locking mechanism formed of the screw 78, the ball 76, and so forth is not required.

The pipe connecting portion 35 is provided at a tip end portion of the piston rod 30 projecting out from the cylinder tube 10. Two tubes 48 and 49 that project in the radial direction of the piston rod 30 are welded and connected to the pipe connecting portion 35. The pipes extending from the hydraulic power source are respectively connected to the tubes 48 and 49.

A head-side rod inner passage 11 that communicates the first tube 48 with the head-side chamber 2 and a bottom-side rod inner passage 21 that communicates the second tube 49 with the bottom-side chamber 3 are provided in the interior of the solid piston rod 30.

FIG. 1 shows a state in which the hydraulic cylinder 1 is contracted. When the hydraulic cylinder 1 is operated so as to extend, the pressurized working oil supplied from the hydraulic power source flows into the bottom-side chamber 3 through the bottom-side rod inner passage 21. As the piston 70 moves towards the head side (right direction in FIG. 1), the working oil in the head-side chamber 2 flows out to a tank of the hydraulic power source through the head-side rod inner passage 11. On the other hand, when the hydraulic cylinder 1 is operated so as to contract, the pressurized working oil supplied from the hydraulic power source flows into the head-side chamber 2 through the head-side rod inner passage 11. As the piston 70 moves towards the bottom side (left direction in FIG. 1), the working oil in the bottom-side chamber 3 flows out to the tank of the hydraulic power source through the bottom-side rod inner passage 21.

The bottom-side rod inner passage 21 is defined by an axial hole 22 that extends in the center axis O direction of the piston rod 30, a rod port 23 that extends in the radial direction of the piston rod 30 from the first end of the axial hole 22, and a groove 24 that opens at a proximal end surface of the piston rod 30. The rod port 23 opens at the pipe connecting portion 35 and communicates with the interior of the tube 49. The axial hole 22, the rod port 23, and the groove 24 are respectively formed by machining.

The head-side rod inner passage 11 is defined by an axial hole 12 that extends in the center axis O direction of the piston rod 30, a rod port 13 that extends in the radial direction of the piston rod 30 from the first end of the axial hole 12, and a port 14 that extends in the radial direction from a middle part of the axial hole 12. The rod port 13 opens at the pipe connecting portion 35 and communicates with the interior of the tube 48. The port 14 opens at the piston rod 30 so as to face against the head-side chamber 2. The axial hole 12, the rod port 13, and the port 14 are respectively formed by machining.

Because the axial hole 12 defining the head-side rod inner passage 11 opens to the bottom-side chamber 3, it is necessary to seal an open end 16 of the head-side rod inner passage 11 (the axial hole 12) that opens to the bottom-side chamber 3.

The piston rod 30 has a sealing mechanism so as to seal the open end 16 of the head-side rod inner passage 11. The sealing mechanism has a plug 40 that is inserted from the open end 16 of the axial hole 12 and a pin 57 that locks rotation of the plug 40.

Figure 4:
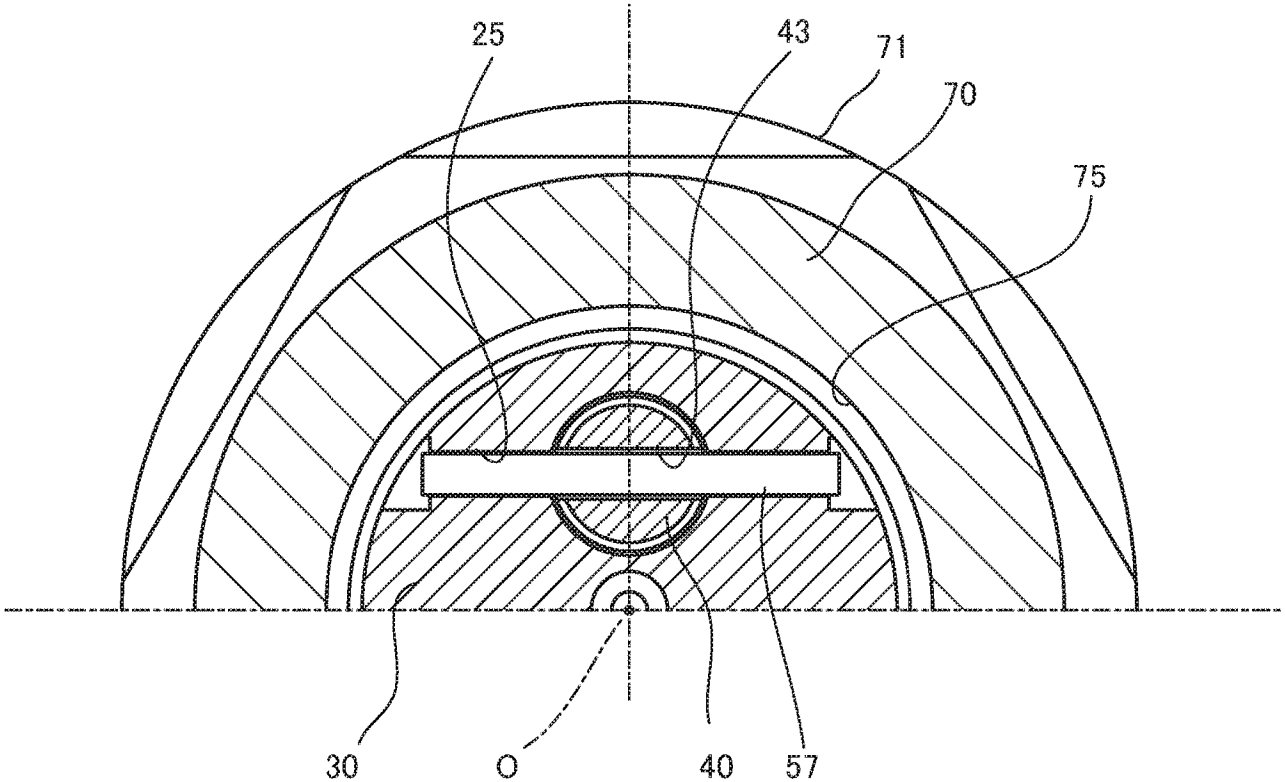
FIG. 4 is a sectional view taken along a line IV-IV in FIG. 3.

As shown in FIGS. 2 to 4, on an inner circumference of the axial hole 12, an inner-circumference screw portion 28 into which the plug 40 is screwed is formed.

A lateral hole 25 into which the pin 57 is inserted is formed in the piston rod 30. The lateral hole 25 is formed so as to extend along the radial direction of the piston rod 30 so as to cross the axial hole 12. The term "radial direction" means a radial direction centered at the center axis O of the piston rod 30.

The lateral hole 25 is formed so as to be located inside the piston 70. Therefore, even if the pin 57 is projected out from the lateral hole 25, the pin 57 is brought into contact with an inner circumferential surface 75 of the piston 70. Thus, the pin 57 is prevented from falling off by the piston 70.

The pin 57 is a spring pin that has a C-shaped cross-section, and is press fitted into the lateral hole 25. The pin 57 is not limited to this configuration, and a solid columnar member may be used as the pin 57.

Figure 5A:
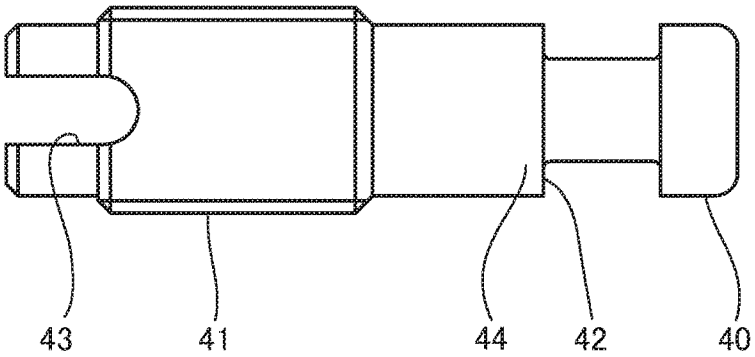
FIG. 5A is a front view of a plug.
Figure 5B:
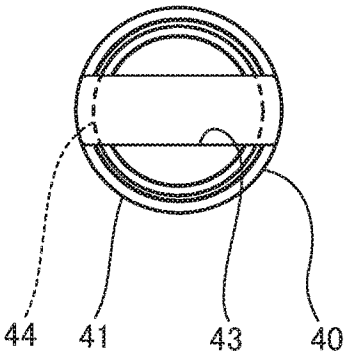
FIG. 5B is a plan view of the plug.

As shown in FIGS. 5A and 5B, the columnar plug 40 has an outer-circumference screw portion 41 that is screwed into the inner-circumference screw portion 28 of the axial hole 12, a plug body portion 44 that is fitted to an inner circumferential surface 29 of the axial hole 12, an outer circumference groove 42 that is formed on the plug body portion 44, and an engagement portion 43 that engages with the pin 57.

The engagement portion 43 is formed to have a slit-shape that opens at a proximal end portion of the plug 40. By placing the pin 57, which has been inserted through the lateral hole 25 of the piston rod 30, in the engagement portion 43, rotation of the plug 40 is locked.

The engagement portion 43 is not limited to the configuration mentioned above, and the engagement portion 43 may be a through hole that opens at the proximal end portion of the plug 40.

A seal ring 55 is interposed in the outer circumference groove 42 of the plug 40. The seal ring 55 is a ring-shaped elastic body. By inserting the plug 40 into the axial hole 12 together with the seal ring 55, the seal ring 55 is compressed and brought into contact with the inner circumferential surface 29 of the axial hole 12 and a bottom surface of the outer circumference groove 42. As a result, a space between the plug 40 and the axial hole 12 is sealed without forming a gap.

Backup rings 56 may also be provided in the outer circumference groove 42 of the plug 40 so as to sandwich the seal ring 55.

The configuration is not limited to that described above, and the space between the plug 40 and the axial hole 12 may be sealed without using the seal ring 55 etc., by fitting the outer circumferential surface of the plug body portion 44 of the plug 40 to the inner circumferential surface 29 of the axial hole 12 without forming a gap.

According to the above-mentioned first embodiment, operational advantages described below are afforded.

The plug 40 is screwed into the head-side rod inner passage 11, and furthermore, the rotation of the plug 40 is locked by the pin 57. Therefore, it is possible to close the head-side rod inner passage 11 with the plug 40 and to prevent the plug 40 from falling off to the interior of the cylinder tube 10. In addition, the seal ring 55 is provided on the plug 40. Thus, even if the plug 40 is moved slightly in the axial direction, the sealed state between the axial hole 12 and the plug 40 is maintained by the seal ring 55.

In addition, because the pin 57 that locks the rotation of the plug 40 is provided inside the piston assembly 71, the pin 57 is prevented from falling off. Therefore, it is possible to reliably close the head-side rod inner passage 11 with the plug 40. When the piston assembly 71 has a piston that is linked to the piston rod 30 and a nut that is screwed into the piston rod 30, the pin 57 may be disposed inside the nut, and thereby, the pin 57 may be prevented from falling off by an inner circumferential surface of the nut.

Second Embodiment

Figure 6:
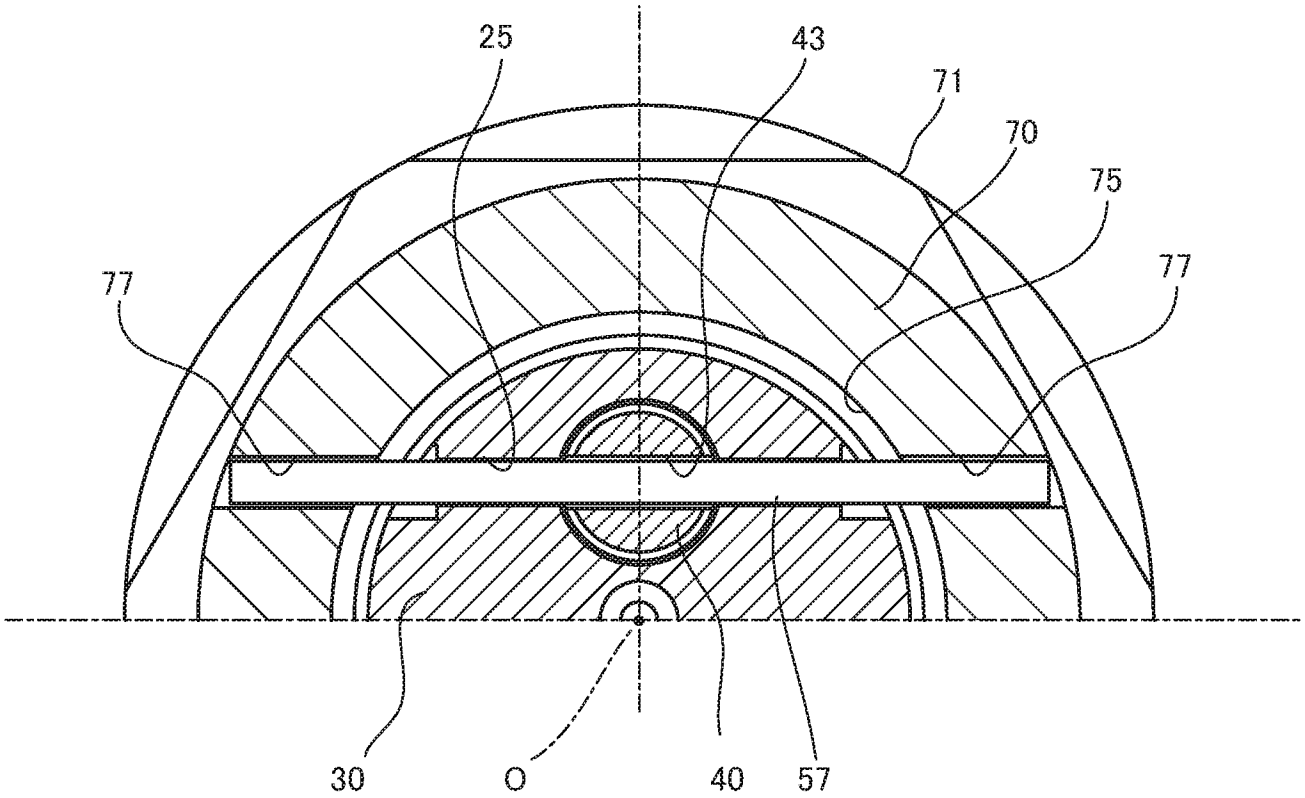
FIG. 6 is a sectional view of a fluid pressure cylinder according to a second embodiment of the present invention.

Next, a second embodiment of the present invention will be described with reference to FIG. 6. Differences from the first embodiment will mainly be described below, while configurations that are same as those of the fluid pressure cylinder of the first embodiment are assigned the identical reference signs and descriptions thereof will be omitted.

In the first embodiment, the pin 57 is disposed inside the piston 70, and the pin 57 is prevented from falling off by the inner circumferential surface 75 of the piston 70. In contrast, in the second embodiment, the rotation of the piston assembly 71 is locked by engaging the pin 57 with the piston 70.

Engagement portions 77 that engage with the pin 57 are formed on the piston 70 of the piston assembly 71. The engagement portions 77 are formed of two holes that are formed in the piston 70 so as to sandwich the lateral hole 25 formed in the piston rod 30. Both end portions of the pin 57 are inserted into the engagement portions 77.

The pin 57 locks the rotation of the plug 40 by being engaged with the engagement portion 43 of the plug 40 and locks the rotation of the piston assembly 71 by being engaged with the engagement portions 77 of the piston assembly 71.

According to the above-mentioned second embodiment, operational advantages similar to those in the first embodiment are afforded and operational advantages described below are afforded.

Because the pin 57 locks the rotation of the piston assembly 71, it is possible to prevent loosening of a fastened portion of the piston assembly 71. In addition, because the rotation locking mechanism of the piston assembly 71 formed of the screw 78, the ball 76, and so forth is not employed, it is possible to simplify the configuration.

When the piston assembly 71 has the piston linked to the piston rod 30 and the nut screwed to the piston rod 30, the rotation of the nut may be locked by engaging the pin 57 with an engagement portion formed on the nut.

Embodiments of the present invention were described above, but the above embodiments are merely examples of applications of the present invention, and the technical scope of the present invention is not limited to the specific constitutions of the above embodiments.

For example, in the above-mentioned embodiment, although the hydraulic cylinder 1 is of a double acting type, in which the working oil is respectively supplied to or discharged from the head-side chamber 2 and the bottom-side chamber 3, the hydraulic cylinder 1 may be of a single acting type.

In addition, although the fluid pressure cylinder is the hydraulic cylinder 1, the fluid pressure cylinder may use gas as the working fluid.

This application claims priority based on Japanese Patent Application No. 2013-155369 filed with the Japan Patent Office on Jul. 26, 2013, the entire contents of which are incorporated into this specification.

The invention claimed is:

1. A fluid pressure cylinder in which a piston rod moves in an axial direction by working-fluid pressure guided from a fluid pressure source to an interior of a cylinder tube, comprising:

a rod inner passage that is formed in the piston rod along the axial direction and communicates the fluid pressure source with the interior of the cylinder tube;

a plug that closes an open end that opens to the interior of the cylinder tube of the rod inner passage;

a lateral hole that is formed in the piston rod along a radial direction and opens to the rod inner passage;

a pin that is inserted into the lateral hole; and a piston assembly that is linked to the piston rod, wherein an inner-circumference screw portion is formed on an inner circumference of the rod inner passage, the plug has an outer-circumference screw portion that is screwed into the inner-circumference screw portion and an engagement portion that is engaged with the pin and locks rotation of the plug, the pin is disposed at inside of the piston assembly, and the pin is prevented from falling off by an inner circumferential surface of the piston assembly.

2. A fluid pressure cylinder in which a piston rod moves in an axial direction by working-fluid pressure guided from a fluid pressure source to an interior of a cylinder tube, comprising:

a rod inner passage that is formed in the piston rod along the axial direction and communicates the fluid pressure source with the interior of the cylinder tube;

a plug that closes an open end that opens to the interior of the cylinder tube of the rod inner passage;

a lateral hole that is formed in the piston rod along a radial direction and opens to the rod inner passage;

a pin that is inserted into the lateral hole; and a piston assembly that is fastened to the piston rod, wherein an inner-circumference screw portion is formed on an inner circumference of the rod inner passage, the plug has an outer-circumference screw portion that is screwed into the inner-circumference screw portion and an engagement portion that is engaged with the pin and locks rotation of the plug, and the piston assembly has an engagement portion that is engaged with the pin and locks rotation of the piston assembly.

3. The fluid pressure cylinder according to claim 1, wherein the pin is inserted into the lateral hole so as to cross the rod inner passage.

4. The fluid pressure cylinder according to claim 1, further comprising a seal ring that is interposed between the inner circumference of the rod inner passage and the plug, wherein the plug has an outer circumference groove into which the seal ring is interposed, and a space between the plug and the rod inner passage is sealed by the seal ring.

5. The fluid pressure cylinder according to claim 2, wherein the pin is inserted into the lateral hole so as to cross the rod inner passage.

6. The fluid pressure cylinder according to claim 2, further comprising a seal ring that is interposed between the inner circumference of the rod inner passage and the plug, wherein the plug has an outer circumference groove into which the seal ring is interposed, and a space between the plug and the rod inner passage is sealed by the seal ring.

* * * * *